US009644843B2

(12) United States Patent
Herborth

(10) Patent No.: US 9,644,843 B2
(45) Date of Patent: May 9, 2017

(54) COMBUSTOR HEAT-SHIELD COOLING VIA INTEGRATED CHANNEL

(71) Applicant: Pratt & Whitney Canada Corp., Langueuil (CA)

(72) Inventor: Jason Herborth, Acton (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 589 days.

(21) Appl. No.: 14/048,458

(22) Filed: Oct. 8, 2013

(65) Prior Publication Data

US 2015/0096302 A1 Apr. 9, 2015

(51) Int. Cl.

| | |
|---|---|
| ***F23R 3/00*** | (2006.01) |
| ***F23R 3/60*** | (2006.01) |
| ***F23R 3/54*** | (2006.01) |

(52) U.S. Cl.

CPC ..... *F23R 3/002* (2013.01); *F23R 3/54* (2013.01); *F23R 3/60* (2013.01); *F23R 2900/03044* (2013.01)

(58) Field of Classification Search

CPC .... F23R 3/002; F23R 3/60; F23R 3/10; F23R 3/54; F23R 2900/00017; F23R 2900/03044; F23R 3/06; F23R 2900/03041–2900/03045; F23M 5/08; F23M 5/085; F05D 2260/22141; F05D 2260/31; F05D 2260/201; F02C 7/24; F16B 43/003; F16B 43/02; F16B 21/09

See application file for complete search history.

(56) References Cited

U.S. PATENT DOCUMENTS

| | | | | |
|---|---|---|---|---|
| 4,422,300 | A * | 12/1983 | Dierberger | F23R 3/007 60/753 |
| 4,749,298 | A * | 6/1988 | Bundt | F02K 1/82 165/134.1 |
| 5,072,785 | A * | 12/1991 | Dressler | F01D 25/243 165/134.1 |
| 5,079,912 | A * | 1/1992 | Cires | F02K 1/12 239/127.1 |
| 9,518,737 | B2 * | 12/2016 | Pidcock | F23R 3/002 |
| 2002/0124572 | A1 * | 9/2002 | Pidcock | F23R 3/002 60/796 |

(Continued)

FOREIGN PATENT DOCUMENTS

CN 202418176 U 9/2010

*Primary Examiner* — Gerald L Sung
*Assistant Examiner* — Thomas Burke
(74) *Attorney, Agent, or Firm* — Norton Rose Fulbright Canada LLP

(57) ABSTRACT

A combustor heat shield for a gas turbine engine has a heat shield panel adapted to be mounted to an inner surface of a combustor shell with a back face of the panel spaced-apart from the combustor shell to define an air gap therewith. Studs project from the back face of the panel for engagement in corresponding mounting holes defined in the combustor shell. Each stud has a threaded distal end portion for engagement with a nut outside of the combustor shell. At least one of the studs has a channel defined in a peripheral surface thereof. The channel extends longitudinally along the stud from an inlet end connectable to a source of cooling air outside of the combustor shell to an outlet end disposed within the air gap for locally providing cooling air at the base of the stud.

13 Claims, 5 Drawing Sheets

(56) References Cited

U.S. PATENT DOCUMENTS

| | | | | |
|---|---|---|---|---|
| 2003/0123953 | A1* | 7/2003 | Razzell | F01D 25/243<br>411/419 |
| 2008/0104962 | A1* | 5/2008 | Patel | F23R 3/10<br>60/752 |
| 2008/0264065 | A1* | 10/2008 | Gerendas | F23R 3/002<br>60/754 |
| 2011/0011095 | A1* | 1/2011 | Ladd | F23R 3/002<br>60/796 |
| 2016/0186997 | A1* | 6/2016 | Sadil | F02C 7/24<br>60/772 |
| 2016/0313005 | A1* | 10/2016 | Chang | F23R 3/002 |

* cited by examiner

COMBUSTOR HEAT-SHIELD COOLING VIA INTEGRATED CHANNEL

TECHNICAL FIELD

The application relates generally to gas turbine engine and, more particularly, to combustor heat shield cooling.

BACKGROUND OF THE ART

Gas turbine combustors are the subject of continual improvement, to provide better cooling, better mixing, better fuel efficiency, better performance, etc. at a lower cost. For example, heat shields are known to provide better protection to the combustor, but heat shields also require cooling. The heat shield panels are typically mounted to the combustor shell by means of studs extending from the back face of each panel for engagement with bolts on the outside of the combustor shell. The cooling of some panel areas around the studs may be challenging, especially on smaller sized heat shield panels, and, thus, hot spots may occur.

SUMMARY

In one aspect there is provided a combustor heat shield for a gas turbine engine, comprising: a heat shield panel adapted to be mounted to in spaced-apart relationship to an inner surface of a combustor shell to define an air gap therebetween them, a plurality of studs projecting from the back face of the heat shield panel, at least one of the studs having a threaded portion at a distal end and a channel defined in a peripheral surface of the at least one stud, the channel extending along the at least one stud from an inlet end at the stud distal end connectable to a source of cooling air outside of the combustor shell to an outlet end disposed so as to communicate with the air gap when the heat shield panel is mounted to the combustor shell.

In a second aspect, there is provided a gas turbine engine combustor comprising: a combustor shell defining a combustion chamber; and a heat shield mounted to an inner surface of the combustor shell, the heat shield having a back face facing the inner surface of the combustor shell and being spaced therefrom to define an air gap, cooling holes in said combustor shell for directing a primary flow of cooling air over said back face of the heat shield, the heat shield further having studs projecting from the back face thereof through corresponding mounting holes defined in the combustor shell for threaded engagement with associated nuts outside of the combustor shell, each stud and associated nut forming a stud and nut assembly, at least one of said stud and nut assembly defining a channel extending longitudinally between an inlet end connected to a source of cooling air and an outlet end in communication with the air gap, the outlet end being oriented to direct cooling air flowing through said channel in a direction generally corresponding to the primary flow of the cooling air flowing over the back face of the heat shield panel.

DESCRIPTION OF THE DRAWINGS

Reference is now made to the accompanying figures, in which.

DETAILED DESCRIPTION OF THE PREFERRED EMBODIMENTS

Figure 1:
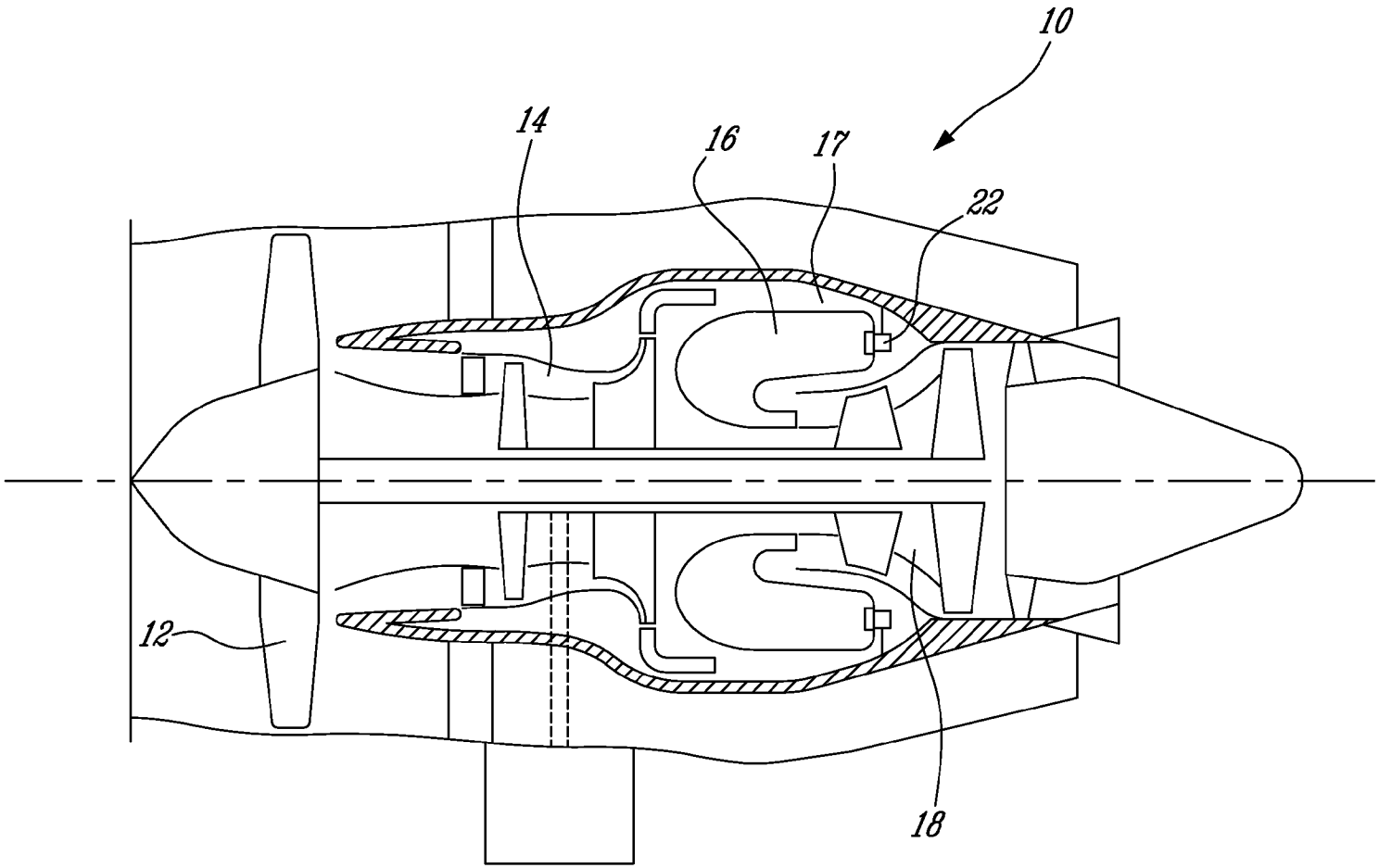
FIG. 1 is a schematic cross-section view of a turbofan gas turbine engine.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
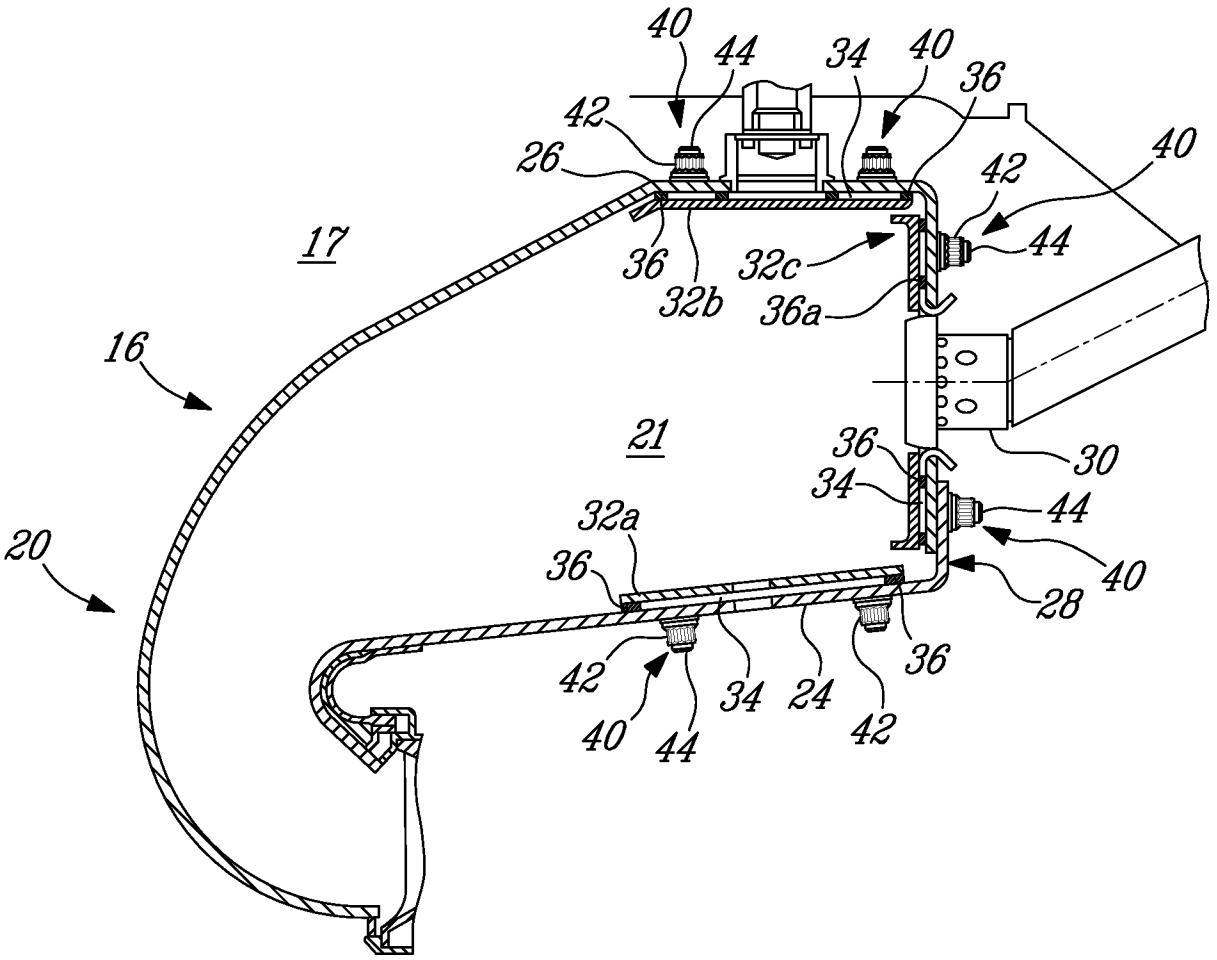
FIG. 2 is a schematic cross-section view of an annular combustor including a combustor shell and heat shield panels bolted to the combustor shell.

The combustor 16 is housed in a plenum 17 supplied with compressed air from compressor 14. As shown in FIG. 2, the combustor 16 typically comprises a sheet metal shell 20 including radially inner and radially outer liners 24, 26 extending from a dome or bulkhead 28 so as to define an annular combustion chamber 21. A plurality of circumferentially spaced-apart nozzles (only one being shown at 30 in FIG. 2) are provided at the bulkhead 28 to inject a fuel/air mixture into the combustion chamber 21. Sparkplugs (not shown) are provided along the upstream end portion of the combustion chamber 21 downstream of the tip of the nozzles in order to initiate combustion of the fuel/air mixture delivered into the combustion chamber 21.

The radially inner and outer liners 24, 26 and the bulkhead 28 are provided on their hot interior side with heat shields. The heat shields can be segmented to provide a thermally decoupled combustor arrangement. For instance, circumferential arrays of heat shield panels 32*a*, 32*b* can be respectively mounted to the hot interior side of the radially inner and radially outer liners 24, 26, and another circumferential array of heat shield panels 32*c* can be mounted to the hot interior side of the dome or bulkhead 28. It is understood that more than one circumferential array of heat shield panels can be mounted axially along the inner and outer liners 24, 26. Reference numeral 32 will be used herein after to generally refer to the heat shield panels irrespectively of their positions on the combustor shell 20.

Figure 3:
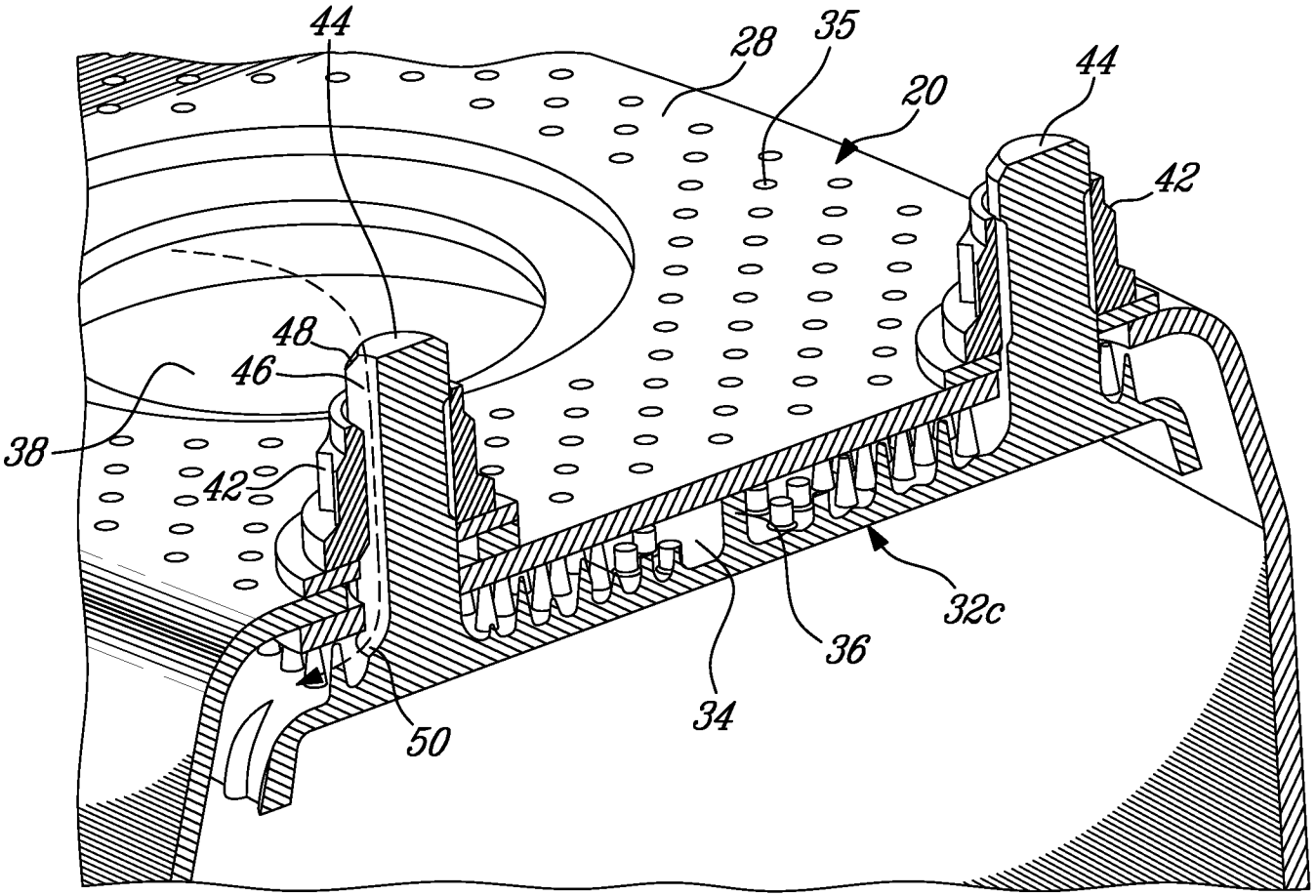
FIG. 3 is an isometric view of a heat shield panel bolted to the combustor dome and illustrating a path of cooling air integrated to a stud of the heat shield panel.

The heat shield panels 32 are mounted to the combustor shell 20 with the back face of the heat shield panels 32 in closed facing, space-apart, relationship with the interior surface of the combustor shell 20. The back face of the heat shield panels 32 and the interior surface of the combustor shell 20 define an air gap 34 for receiving cooling air to cool down the heat shield panels 32. Cooling holes, such as impingement holes, shown at 35 in FIG.3, are defined in the combustor shell 20 for directing air from the plenum 17 into the air gap 34. Sealing rails 36 projecting from the back face of the heat shield panels 32 into sealing engagement with the interior surface of the combustor shell 20 provide for the compartmentalization of the air gap 34 formed by each array of heat shield panels 32 and the interior side of the combustor shell 20. The sealing rails 36 may take various forms. For instance, they can take the form of a ring 36*a* (FIG. 4) surrounding a fuel nozzle opening 38 defined in a bulkhead heat shield 32*c*, a peripheral rim 36*b* or even just a ridge 36*c* extending integrally from the back face of a heat shield panel. The term "sealing rail" is herein intended to encompass all types of sealing surfaces projecting from the back face of the heat shields for engagement with the interior side of the combustor shell.

As shown in FIG. 2, bolted connections 40 are provided for individually securing the heat shield panels 32 in position relative to the combustor shell 20 with the sealing rails 36 of the panels in sealing contact with the interior side of the combustor shell 20. As shown in FIG. 2, the bolted connections 40 may, for instance, include self-locking nuts 42 threadably engaged on the threaded distal end of studs 44 projecting from the back face of the heat shield panels 32. The studs 44 may be integrally cast with the panels 32. Alternatively, the studs 44 may be joined to the panels by any suitable joining techniques.

More particularly, as shown in FIG. 3 with reference to the dome heat shield panels 32*c*, each individual heat shield panel has a plurality of studs 44 projecting from the back face thereof for engagement in corresponding mounting holes defined in the combustor shell 20. The threaded distal end of the studs 44 extends beyond the shell exterior surface for engagement with the nuts 42. After engagement of the nuts 42 with the exterior surface of the combustor shell 20, the continued tightening of the nuts 42 causes the sealing rails 36 of the heat shield panels 32 to be drawn against the interior surface of the combustor shell 20. To ensure proper sealing contact between the rails 36 and the interior surface of the combustor shell 20 a plurality of bolted connections is provided for each panel. Typically, a stud is provided at each corner of the panels and additional studs may provided along the opposed circumferential edges of the panel.

The cooling of the heat shield panels 32 around the base of the studs 44 may be challenging. This is especially true for small combustion shells where there is little or no room in the combustor shells to provide cooling holes adjacent to and on the downstream side of the studs relative to a primary flow direction of cooling air over the back face of the heat shield panel. Also, when used, washers around the studs may block cooling holes in the combustor liner and, thus, prevent the delivery of cooling air around the base of the studs. Improper or insufficient cooling of the areas around the studs may result in hot spots. Also if the studs are not properly cooled their structural integrity may be compromised.

Figure 4:
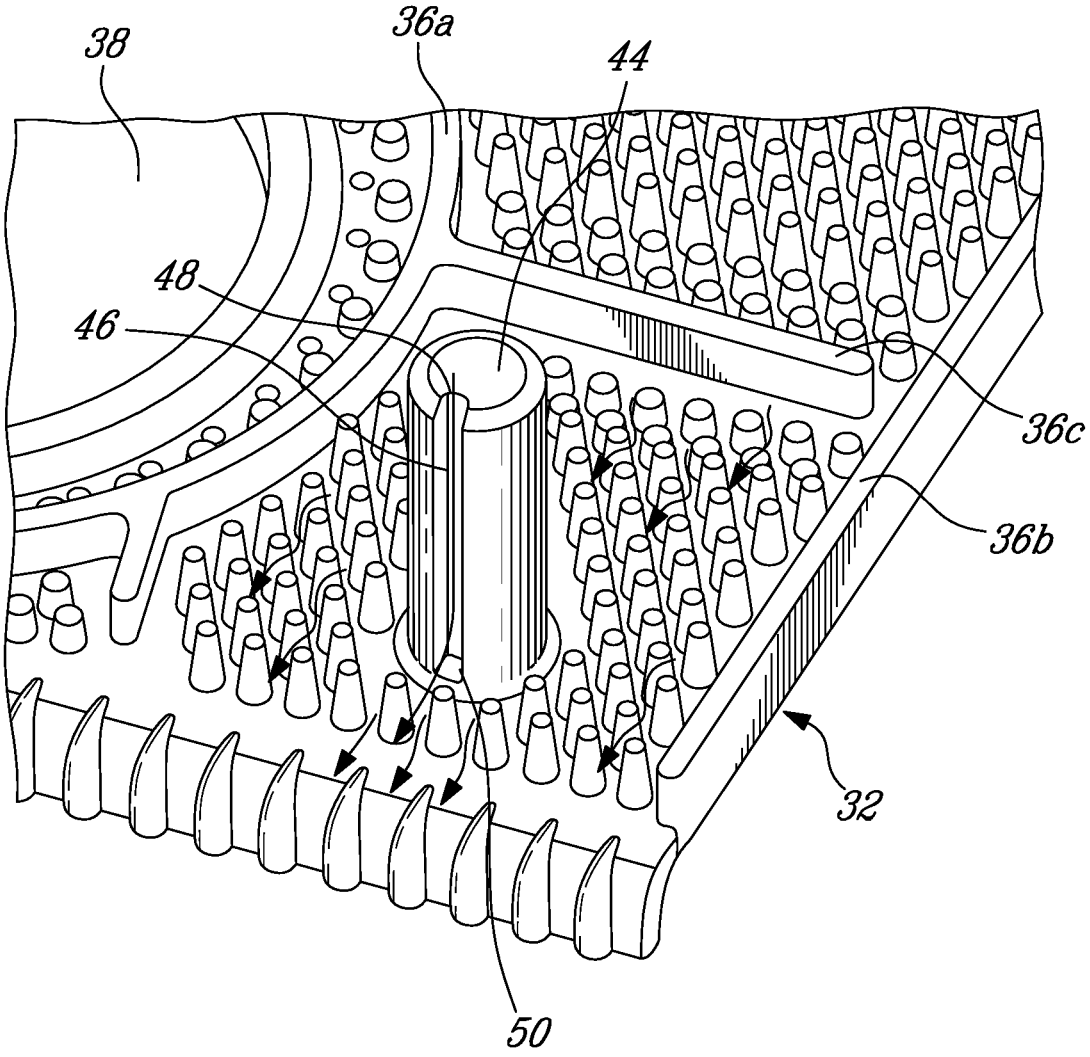
FIG. 4 is an isometric view of the back face of the combustor dome heat shield panel illustrated in FIG. 3 and showing a slot define in the stud to allow cooling air to enter an air gap between the combustor dome and the back face of the combustor heat shield panel.
Figure 5:
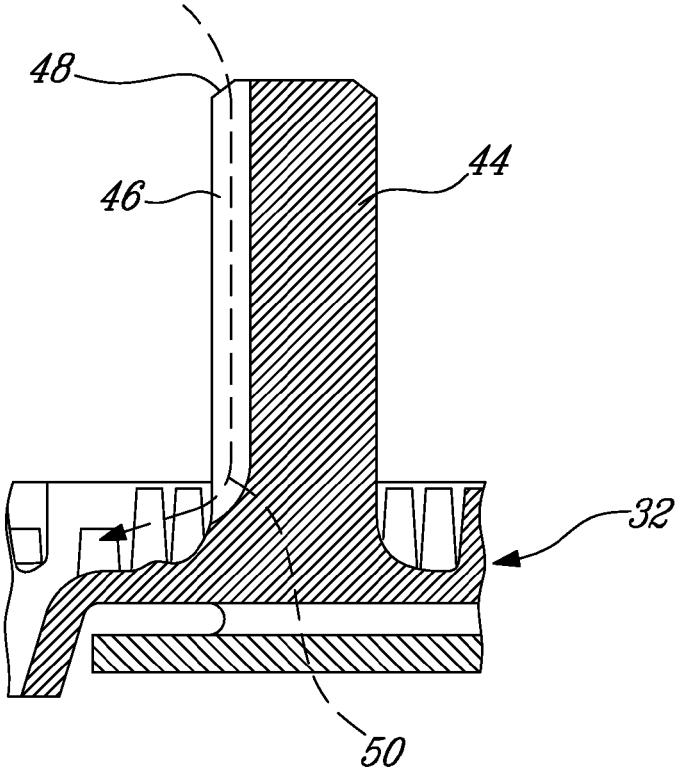
FIG. 5 is a cross-section view through the stud and illustrating the path of cooling air defined by the peripheral slot machined along the stud.

As shown in FIGS. 3 to 6, a slot 46 may be readily machined or otherwise suitably formed in a peripheral surface of a stud 44 to locally direct cooling air at the base of the stud. It is understood that slots can be made on one or all studs (as required). The slot 46 extends longitudinally along the stud 44 between an inlet end 48 which opens up in the plenum 17 for receiving cooling air to an outlet end 50 which is located at the base of the stud 44 in the air gap 34 between the heat shield panel 32 and the combustor shell 20. The slot 46 extends through the threads (not shown) of the stud 44 and, thus, the air flows between the nut 42 and the stud 44 as shown in FIG. 3. The outlet end 50 of the slot 46 may have a fillet radius to smoothly re-direct the incoming flow of cooling air in a direction generally parallel to the back face of the heat shield panel 32. As shown in FIG. 4, the slot 46 may be defined in the downstream side of the stud 44 relative to a primary flow direction of the cooling air (see flow arrows in FIG. 4) over the back face of the heat shield panel 32 and the outlet end 50 may be oriented to direct the air flowing through the slot 46 in a direction generally corresponding to the primary flow direction. Using a slot 46 with a fillet radius at the outlet end 50 ensures a smooth transition for the air while at the same time allowing the air to be directed to a very specific direction, as opposed to impingement holes. The orientation and size of the slot 46 can be customized to suite the individual liner cooling needs. As well, the slot 46 can provide larger quantities of cooling air if required. The size of the slot 46 can be large enough to prevent any blockage due to foreign and cleaning. Using a slot, the air cooling channel is open for machining and cleaning. This also facilitates a larger of quantity of fast moving air to keep the base of the stud cool, thereby contributing to the durability of the stud 44.

Figure 6:
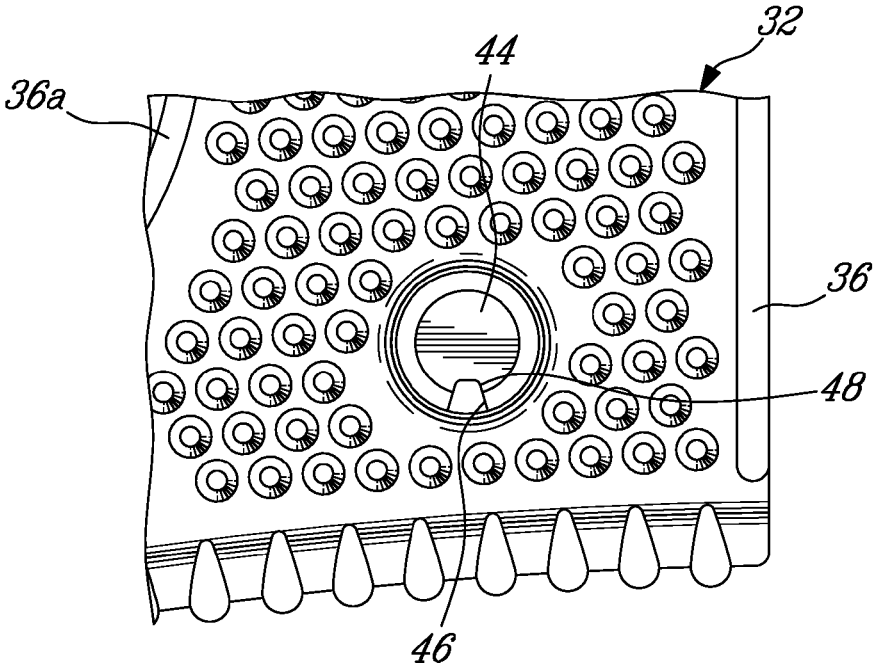
FIG. 6 is an enlarged plan view of a corner portion of the back face of the heat shield panel and illustrating the slot in the stud.

Referring to FIG. 6, it is noted that the profile radius of the slot 46 can be changed to better suit the strength requirements of the material/design. This would not be possible with a hole drilled through the stud.

The above description is meant to be exemplary only, and one skilled in the art will recognize that changes may be made to the embodiments described without departing from the scope of the invention disclosed. For instance, the air cooling channel could be partly or totally defined in the nut engaged on the threaded faster. A slot could be formed at the inner diameter of the nut. Any modifications which fall within the scope of the present invention will be apparent to those skilled in the art, in light of a review of this disclosure, and such modifications are intended to fall within the appended claims.

What is claimed is:

1. A combustor heat shield for a gas turbine engine, comprising:

a heat shield panel adapted to be mounted in spaced-apart relationship to an inner surface of a combustor shell to define an air gap therebetween, a plurality of studs projecting from a back face of the heat shield panel, at least one of the studs being a slotted stud having a threaded portion at a distal end and a channel defined in a peripheral surface thereof, the channel extending along a radially outer edge with respect to a longitudinal axis of the slotted stud through threads of the threaded portion from an inlet end at the stud distal end connectable to a source of cooling air outside of the combustor shell to an outlet end disposed so as to communicate with the air gap when the heat shield panel is mounted to the combustor shell, wherein the outlet end of the channel is disposed between the heat shield panel and the combustor shell such that the cooling air is directed from the outlet end of the channel into the air gap.

2. The combustor heat shield defined in claim 1, wherein the outlet end is provided at a base of the slotted stud and defines a curve to re-direct the cooling air in a direction generally parallel to the back face of the heat shield panel.

3. The combustor heat shield defined in claim 1, wherein the channel is defined in a downstream side of the slotted stud relative to a primary flow direction of cooling air over the back face of the heat shield panel.

4. The combustor heat shield defined in claim 1, wherein the outlet end of the channel has a fillet at a junction between the slotted stud and the back face of the heat shield panel.

5. The combustor heat shield defined in claim 1, wherein a nut is engaged with the threaded portion, and wherein the channel comprises a slot defined in a side of the slotted stud, the slot being partly covered by the nut.

6. The combustor heat shield defined in claim 1, wherein the outlet end is oriented to re-direct the cooling air flow along a primary flow direction of cooling air over the back face of the heat shield panel.

7. A gas turbine engine combustor comprising:

a combustor shell defining a combustion chamber; and a heat shield mounted to an inner surface of the combustor shell, the heat shield having a back face facing the inner surface of the combustor shell and being spaced therefrom to define an air gap, cooling holes in said combustor shell for directing a primary flow of cooling air over said back face of the heat shield, the heat shield further having studs projecting from the back face thereof through corresponding mounting holes defined in the combustor shell, each stud and associated nut forming a stud and nut assembly, at least one of said stud and nut assembly defining a channel extending longitudinally along the at least one stud between an inlet end connected to a source of cooling air and an outlet end disposed between the back face of the heat shield and the inner surface of the combustor shell in direct communication with the air gap, the outlet end being oriented to direct cooling air flowing through said channel in a direction generally corresponding to the primary flow of the cooling air flowing over the back face of the heat shield such that the cooling air is directed from the outlet end of the channel into the air gap, the channel being at least partially defined by an elongated slot defined in a radially outer edge with respect to a longitudinal axis of the stud, wherein the channel extends through threads of a threaded portion at a distal end of the at least one stud.

8. The gas turbine engine defined in claim 7, wherein the channel is defined on a downstream side of the stud relative to a primary flow direction of the primary flow of cooling air, the outlet end being provided at a base of the stud.

9. The gas turbine engine defined in claim 7, wherein the channel is defined at least partly in the nut of the at least one stud and nut assembly.

10. The gas turbine engine combustor defined in claim 8, wherein the outlet end of the channel has a fillet at a junction between the at least one stud and the back face of the heat shield.

11. The gas turbine engine combustor defined in claim 8, wherein the channel extends through the threaded distal end portion of the stud.

12. The gas turbine engine combustor defined in claim 7, wherein the channel is defined partly in a peripheral surface of the stud and partly in the nut of the at least one stud and nut assembly.

13. The gas turbine engine combustor defined in claim 7, wherein the channel is at least partially defined between the nut and the stud.

* * * * *